US005205276A

United States Patent [19]

Aronov et al.

[11] Patent Number: 5,205,276

[45] Date of Patent: Apr. 27, 1993

[54] COMPACT FURNACE HEAT EXCHANGER

[75] Inventors: Michael A. Aronov, Mayfield Hts.; Roger D. Sheridan, Wadsworth, both of Ohio

[73] Assignee: Gas Research Institute, Chicago, Ill.

[21] Appl. No.: 795,507

[22] Filed: Nov. 21, 1991

[51] Int. Cl.[5] ..... F24H 3/08

[52] U.S. Cl. ..... 126/109; 126/99 D; 126/106; 126/110 R; 165/145

[58] Field of Search ..... 126/106, 109, 110 R, 126/116 R, 99 R, 99 A, 99 D, 108, 104 R, 110 E; 165/145

[56] References Cited

U.S. PATENT DOCUMENTS

| | | | |
|---|---|---|---|
| 1,334,741 | 3/1920 | Dundon | 126/109 |
| 1,814,010 | 7/1931 | Snow | 126/109 |
| 2,094,456 | 9/1937 | Lattner | 126/110 R |
| 2,299,901 | 10/1942 | Johnston | 126/109 |
| 4,182,303 | 1/1980 | Muckelrath | 126/110 R |
| 5,094,224 | 3/1992 | Diesch | 126/110 R |

FOREIGN PATENT DOCUMENTS

| | | | |
|---|---|---|---|
| 349809 | 10/1919 | Fed. Rep. of Germany | 126/109 |

*Primary Examiner*—James C. Yeung

*Attorney, Agent, or Firm*—Pearne, Gordon, McCoy & Granger

[57] ABSTRACT

A compact heat exchanger for a fuel-fired heating furnace. The heat exchanger has a radiative heat transfer section including at least one firetube for containing flue gases as the air to be heated passes over the firetube and a convective section including a shell-and-tube heat transfer apparatus arranged to receive flue gases from the firetube in the shell region and the air to be heated after it passes over the firetube in the tubes.

20 Claims, 3 Drawing Sheets

COMPACT FURNACE HEAT EXCHANGER

BACKGROUND OF THE INVENTION

1. Field of the Invention

The invention relates generally to heat exchange systems and is particularly directed to a compact gas-to-air heat exchanger and to a heating system incorporating the heat exchanger.

2. Description of Related Art

Broadly described, fuel-fired hot air heating systems generally comprise a combustion chamber, a heat exchange system for transferring heat from the hot products of combustion or flue gases to fresh or recirculated air, and a blower for moving the air through the heat exchange system and to the spaces which are to be heated. In the heating systems of interest herein, the flow of the combustion products is substantially less than the flow of air to be heated; the two flows may differ by an order of magnitude. For example, the weight ratio of combustion products to air may range from about 1:10 to about 1:12.

Known heat exchange systems for fuel-fired furnaces generally employ at least one shell-and-tube type heat exchanger or finned-tube heat exchanger, wherein the hot combustion products flow through the tubes and the air which is to be heated flows past the tubes in the shell region of the heat exchanger. Clam-shell type heat exchangers, wherein the flue gases flow inside a narrow passageway or channel defined by adjacent walls, are also common. In such prior heat exchangers, the combustion products flow through heat transfer conduits or passageways of relatively smaller total cross-sectional area as compared with the heat transfer conduits or passageways through which the air flows. Typically, the combustion products flow through "inside" passageways such as the inside of a tube of a shell-and-tube arrangement or the interior of the channel defined by the sealed walls of the clam-shell arrangement. In comparison therewith, the air flows through "outside" passageways such as the shell region between the exterior surfaces of the tubes in the tube-and-shell arrangement or the spaces adjacent the exterior surfaces of the walls of the clam-shell arrangement. The inside heat transfer coefficient for such arrangements is usually much less than the outside heat transfer coefficient, which results in the overall rate of heat transfer being controlled by the rate of heat transfer from the hot flue gases to the heat exchange surfaces.

Therefore, with conventional furnace heat exchangers, the amount of heat exchange surface area required to achieve a desired thermal efficiency is largely determined by the inside heat transfer coefficient and almost without any regard to the outside heat transfer coefficient. For these reasons, larger heat exchange surfaces are required with conventional shell-and-tube or clam-shell type furnace heat exchange arrangements than would be needed with a configuration having an inside heat transfer coefficient which is more nearly equal to the outside heat transfer coefficient. A furnace heat exchange configuration which requires less heat exchange surface area to achieve a desired thermal efficiency than conventional shell-and-tube or clam-shell type arrangements, would permit simpler and more compact furnace designs, and would, therefore, be highly advantageous.

Other furnace configurations used in residential applications include condensing-type furnaces such as that shown in U.S. Pat. No. 4,960,102 wherein a radial discharge burner is arranged as a primary heat exchanger/-combustor and the combustion gases pass into a fin-and-tube secondary heat exchanger. The air to be heated passes over the exterior of the finned tubes of the secondary heat exchanger and then over the primary combustor/heat exchanger. U.S. Pat. No. 4,275,705 discloses a condensing-type furnace including a combined primary heat exchanger/combustor having several concentric exchanger runs and a fin-and-tube secondary heat exchanger for receiving combustion products. U.S. Pat. No. 4,941,452 which is owned by the assignee of this application discloses a pulse combustion space heater wherein air to be heated sequentially flows over a fin-and-tube secondary heat exchanger, a tailpipe and a combustion chamber.

SUMMARY OF THE INVENTION

In accordance with the invention, heat exchangers and heating systems of increased efficiency may be provided by arranging the flows of products of combustion and air through associated conduits or passageways sized to more closely match each heat transfer coefficient and to thereby achieve a higher overall heat transfer coefficient. The overall higher heat transfer coefficient enables an increased amount of heat transfer as compared with a similarly constructed heat exchanger having the flow paths reversed. The higher overall heat transfer coefficient also enables the same amount of heat to be transferred with a reduced amount of heat exchanger surface area. The furnace size may be correspondingly reduced.

It is believed that the increases in the inside heat transfer coefficient are associated with the more turbulent flow conditions of the relatively higher flows of air within the inside heat transfer passageway as compared with the more laminar flow conditions of the combustion products within such passageway. The higher inside heat transfer coefficient of the invention contributes to a higher overall heat transfer coefficient, which reduces the amount of heat transfer surface required to achieve a desired thermal efficiency, and thereby facilitates a more compact and simpler heat exchanger design than would otherwise be possible.

In the illustrated embodiments, the total cross- sectional area for the flow of air in the inside passageway is less than the total cross sectional area for the flow of the combustion products in the outside passageway. Since the flow of air may be an order of magnitude or more higher than the flow of combustion products, the air flow conditions are more turbulent and less laminar than those of the combustion products within such passageway.

In heating system applications and apparatus, the heat exchanger may include one or more conduits which are arranged to initially receive the high temperature combustion products from the burner and to transfer heat to air flowing through a first enclosure containing the conduit. Thereafter, the somewhat cooled combustion products are conveyed into a second enclosure which provides the outside passageway and the warmed air from the first enclosure is conveyed into a second conduit or conduits which provide the inside passageway. In such an arrangement, only such initial conduit need be formed of high temperature resistant material, such as stainless steel, and the downstream components may be formed of less high temperature resistant materials.

In the illustrated furnace or space heater applications, the heat exchanger includes a shell-and-tube heat transfer apparatus combined with an inshot burner. The inshot burner has at least one cylindrical firetube mounted within a radiative section or enclosure of the heat exchanger to provide a first conduit of the heat exchanger for receiving the combustion products for heat transfer with air to be heated flowing through the radiative section. The shell-and-tube apparatus provides a convective section of the heat exchanger wherein the tubes receive the warmed air after it passes over the firetube and the shell region receives the combustion products from the firetube. The shell region also includes walls arranged to cause the combustion products to flow transversely back and forth across the tubes and through the shell region along a serpentine flow path.

DESCRIPTION OF THE PREFERRED EMBODIMENTS

Figure 1:
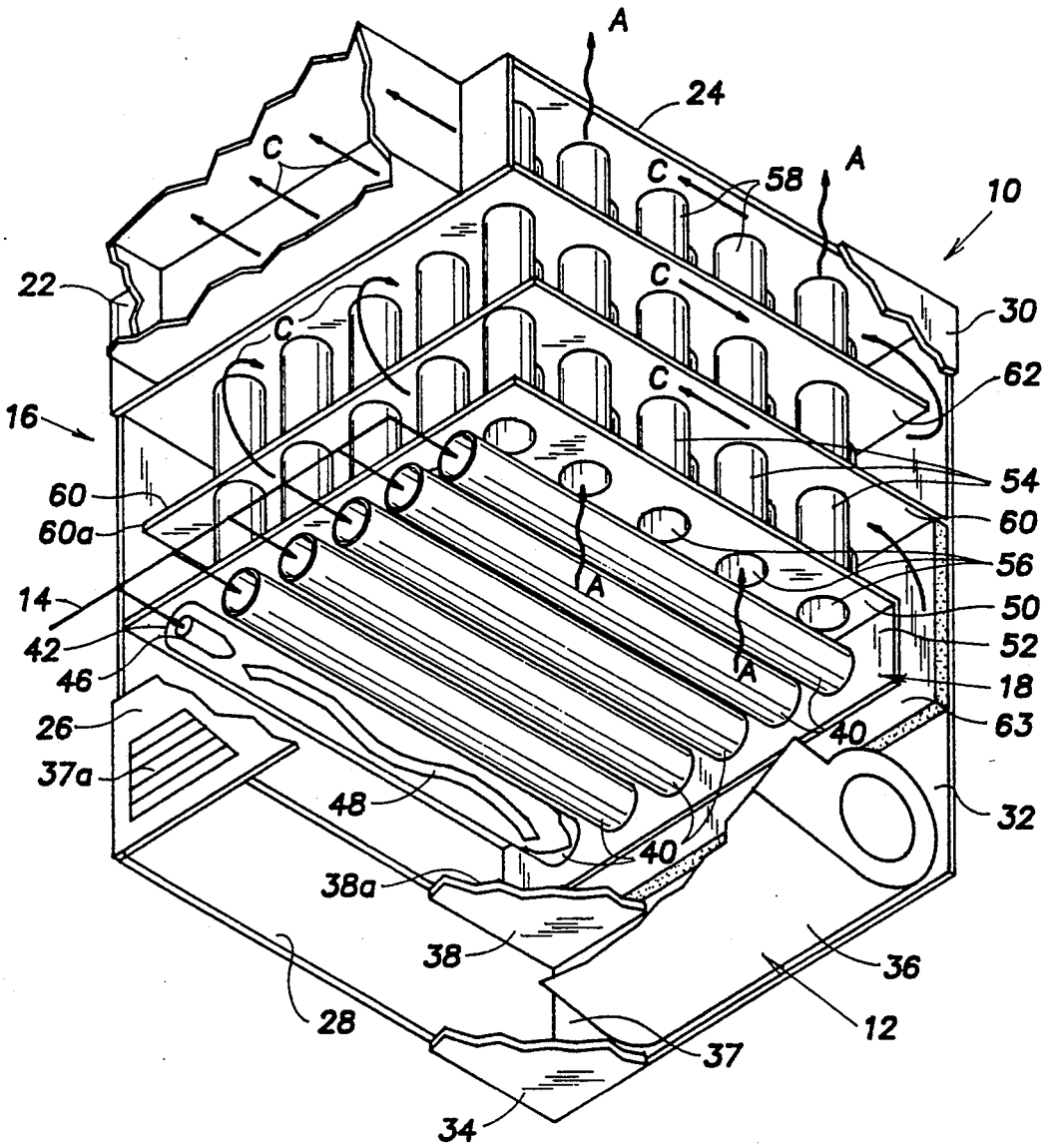
FIG. 1 is a perspective view of a furnace or heating apparatus including a compact heat exchanger embodying the principles of the invention with parts omitted or broken away to show the inner components thereof.
Figure 2:
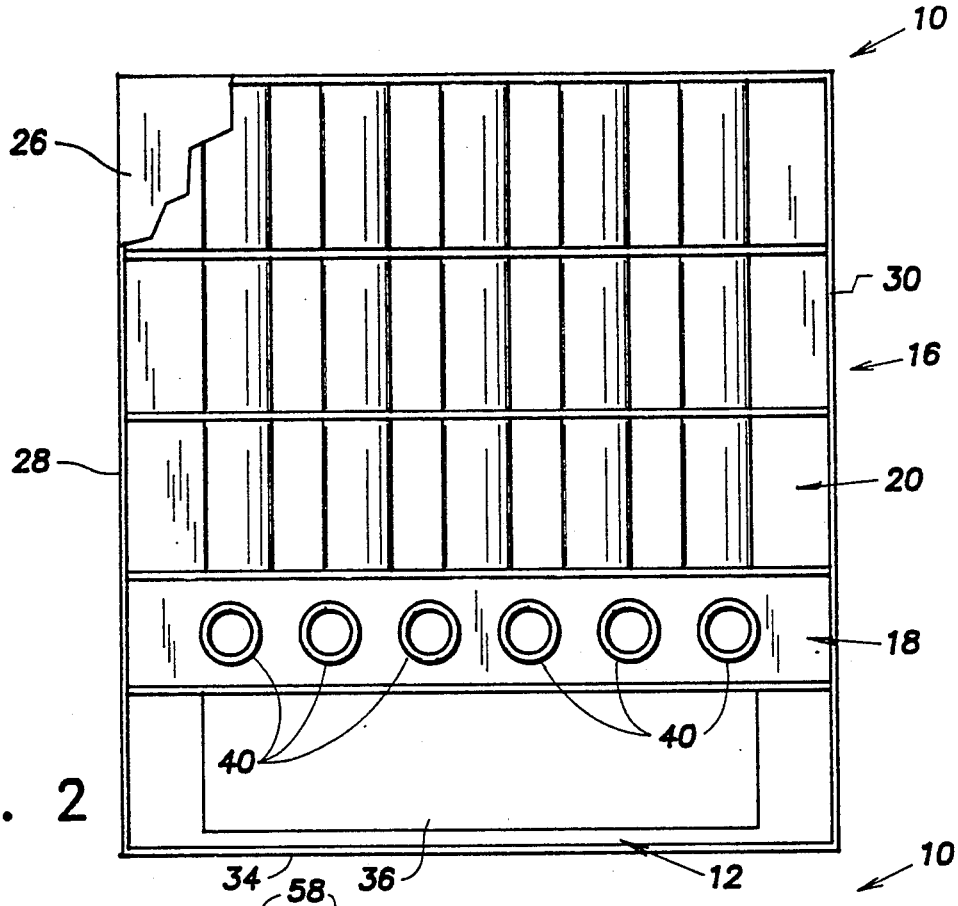
FIG. 2 is a front plan view of the furnace shown in FIG. 1.
Figure 3:
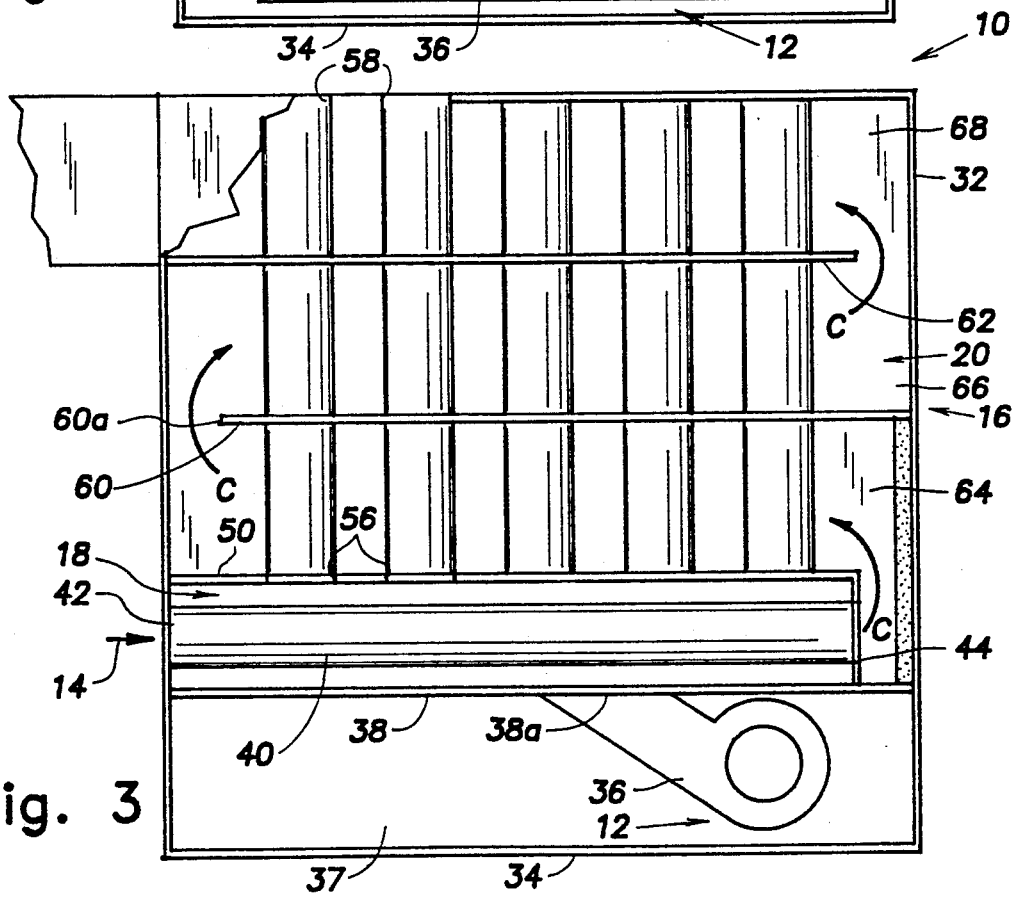
FIG. 3 is a side plan view of the furnace shown in FIG. 1.

A fuel-fired furnace 10 includes a blower assembly 12, a burner assembly schematically shown at 14, and a compact heat exchanger 16 having a radiative heat transfer section or enclosure 18 and a convective heat transfer section or enclosure 20 as shown in FIGS. 1–3. The blower assembly 12 is arranged to flow air to be heated upwardly through the radiative section 18 and the convective section 20 of the heat exchanger 16 and then to the space to be conditioned as indicated by the arrows "A". The products of combustion or flue gases flow along a serpentine flow path through the heat exchanger 16 as indicated by the arrows "C" and transfer a significant amount of the sensible heat energy to the air to be heated prior to being exhausted through a furnace vent 22 for discharge to the atmosphere. The furnace 10 may be sized for residential central heating or for space heating.

The furnace 10 has a generally box-like shape of rectangular cross section including a top wall 24, a front wall 26, opposed sidewalls 28 and 30, a rear wall 32 and a bottom wall 34. As explained below, various of the furnace walls cooperate in fluid tight engagement to enclose and separate furnace components and gaseous flows as well as to define the serpentine flow path for the combustion products. The blower assembly 12 is of conventional design and includes a blower 36 contained within a blower chamber 37 defined by the lower furnace wall 34 and an adjacent intermediate furnace wall 38 together with the surrounding furnace walls 26–32. The blower 36 is arranged to circulate air to be heated to the radiative heat transfer section 18 via an opening **38*a* in the wall 38. The air to be heated may be drawn into the chamber 37 through a louver covered opening 37*a* in the front wall 26** which communicates with the space to be heated.

The radiative heat transfer section 18 contains six firetubes 40 which are equally spaced apart parallel to one another in a horizontal plane. The radiative section 18 provides a parallelepiped-shaped firetube enclosure having an approximately square base and a height approximately 50% larger than the diameter of the firetubes. In the radiative section 18 of the heat exchanger 16, radiation plays a prominent role in the heat exchange process, whereas heat transfer is effected primarily by convection at the shell-and-tube section.

Each firetube 40 includes an inlet end 42 and an outlet end 44. The burner assembly 14 includes separate inshot burners 46 (only one being shown) mounted in associated inlet ends 42 of the firetubes 40. Each burner 46 is a bunsen-type burner adapted to combust natural gas and air with a flame extending from the forward end of the burner. A turbulator or internal baffle 48 is mounted in each firetube 40 to reduce the burner flame length and/or increase heat transfer.

The radiative heat transfer section 18 is enclosed by the lower intermediate furnace wall 38, furnace front and sidewalls 26, 28 and 30, and an adjacent upper intermediate furnace wall 50 having a downwardly depending rear wall 52 joined to the wall 38. The inlet ends 42 and the outlet ends 44 of the firetubes 40 respectively extend through the walls 26 and 52 in fluid tight relationship in order to maintain separation of the combustion products from the air to be heated as the latter flows through the radiative section 18.

The air to be heated passes from the radiative section 18 into a 5×5 array of twenty-five vertical air tubes 54 which extend through the convective heat transfer section 20. The air tubes 54 include inlet ends 56 sealingly engaged within openings in the intermediate wall 50 and outlet ends 58 sealingly engaged within openings in the furnace top wall 24 for delivery of heated air to the space to be heated. Accordingly, the air to be heated is maintained separate from the combustion products within the radiative and convective heat transfer sections 18 and 20.

As best seen in FIG. 3, several additional intermediate furnace walls 60 and 62 cooperate with adjacent furnace walls to divide the length of the convective section 20 into three equal sections and horizontal cross-flow passageways 64, 66 and 68. The passageways cooperate to define a serpentine flow path for the transverse back and forth flow of the combustion products as they pass through the convective heat transfer section 20 prior to discharge through vent 22. The heated air passing from the outlet ends 58 of the air tubes 54 may emerge directly in the space to be conditioned or it may be further conveyed to such space through heating ducts (not shown) in a known manner.

During the operation of the furnace 10, the burners 46 combust a mixture of fuel such as natural gas and air to produce hot flue gases within the firetubes 40. The flue gases pass through the firetubes 40 and exit into the space between the rear wall 52 of the radiative section 18 and the rear wall 32 of the furnace. Since the flue products are still relatively hot, a refractory lining 63 or other type heat insulation is positioned along the interior surface of the rear wall 32. The hot flue gases then flow upwardly into the first horizontal passageway 64. The flue gases flow through the passageway 64 between intermediate walls 50 and 60 and around the bank of vertical tubes 54. The flue gases then impinge upon the furnace front wall 26 and flow upwardly around the exposed edge **60*a* of the wall 60 and into the second horizontal passageway 66 between walls 60 and 62. In a similar manner, the flue gases traverse the second cross flow passageway and impinge upon the furnace rear wall 32 and flow upwardly around the exposed edge 62a of the wall 62 and into the third passageway 68 between the walls 62 and 24. The flue gases exit from the passageway 66 into the furnace vent 22** for discharge to the atmosphere. While natural convection may be used to vent the flue gases, it is preferable to draw the flue gases through the heat exchanger and out the vent with a blower in line with flue ducts.

Air to be heated is drawn into the chamber 37 through the louver covered opening 37a at the bottom of the heat exchanger by blower assembly 12 and passes by and around the radiating firetubes 40 in the radiative section 18. The partially heated air then flows up through the vertical tubes 54 and convective section 20 wherein more heat is transferred from the flue gases to the air via the vertical tube walls. The heated air exiting from the top of the vertical tubes is discharged into the space to be heated by conventional means.

Figure 4:
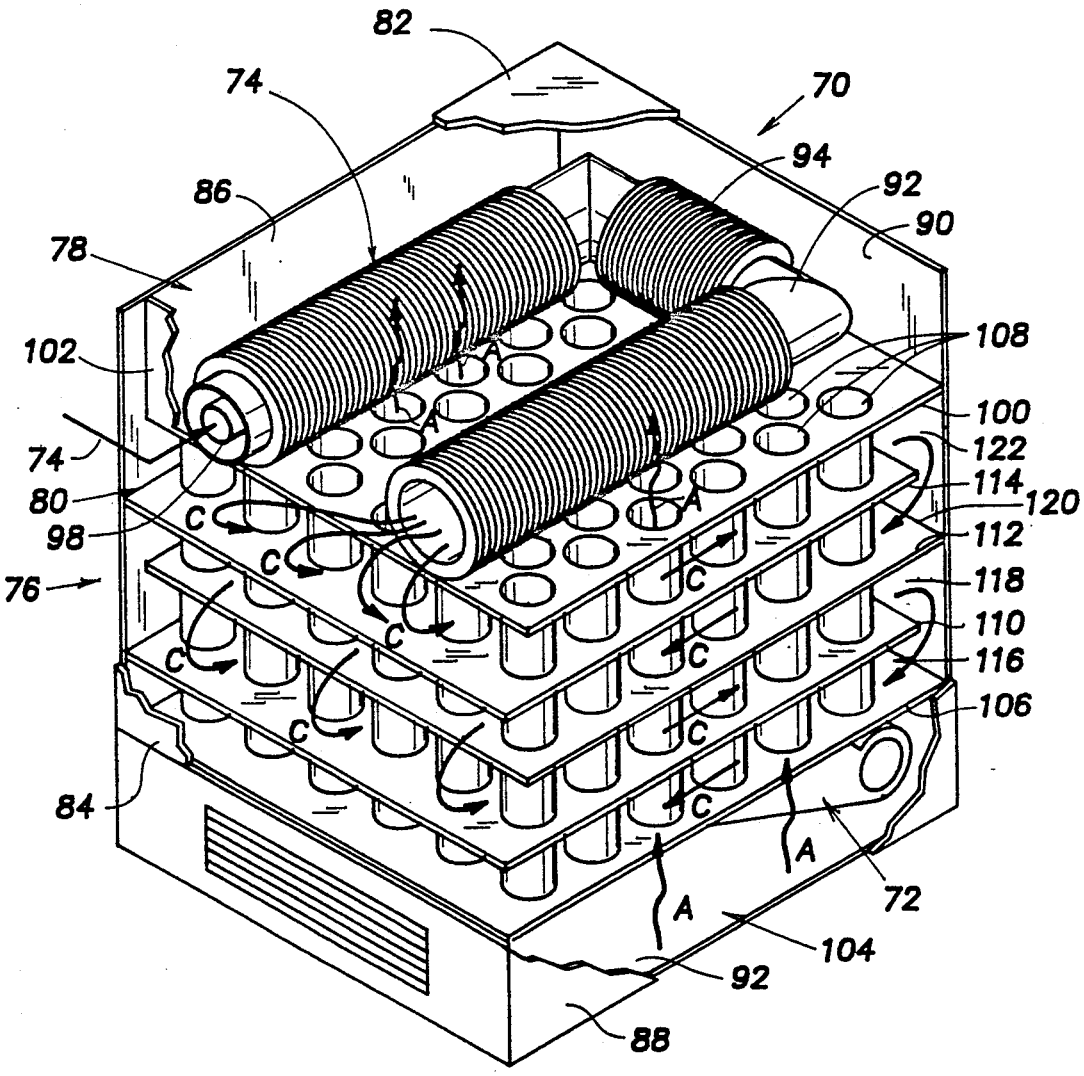
FIG. 4 is a perspective view of another furnace including a compact heat exchanger, which also embodies principles of the present invention, with parts omitted or broken away to show the inner components thereof.

A modified furnace 70 is shown in FIG. 4. The furnace 70 includes a lower blower assembly 72, an upper burner assembly schematically shown at 74, and a compact heat exchanger 76 disposed therebetween. The heat exchanger includes a radiative heat transfer section 78 and a convective heat transfer section 80. As compared with the furnace 10, the radiative and convective heat transfer sections are inverted and countercurrent heat transfer is provided by an upward flow of air as shown by arrows A and a downward flow of combustion products as shown by arrow C. Of course, concurrent heat transfer may be provided by providing a downward air flow. More particularly, the blower assembly 72 is arranged to blow air to be heated upwardly through the convective section 80 and then through the radiative section 78 with countercurrent heat transfer, and to then flow the heated air into the space to be heated. The flue gases are preferably vented by a blower or suction fan. The furnace 70 may be sized for residential central heating or space heating applications.

The furnace 70 has a generally box-like shape of rectangular cross section including a top wall 82, a front wall 84, opposed sidewalls 86 and 88, a rear wall 90 and bottom wall 92. Various of the furnace walls cooperate in fluid tight engagement to engage furnace elements and define furnace flow paths in a manner similar to that described above with respect to the first embodiment.

The burner assembly 74 comprises a single U-shaped firetube 92 having radially extending fins 94 to enhance the heat transfer to the air. The burner assembly 74 includes a single inshot burner 98 sized to provide a desired BTU output.

The radiative heat transfer section 78 is enclosed by the top wall 82, adjacent portions of furnace walls 86, 88 and 90, and an upper intermediate wall 100 having an upwardly depending front wall 102. The inlet and outlet ends of the firetube 94 are sealingly engaged with the depending front wall 102.

The blower assembly 72 is contained within a lower blower chamber 104 formed by the adjacent furnace walls and a lower intermediate wall 106. A 6×6 array of thirty-six vertical air tubes 108 extend from the chamber 104 through the convective section 80 for conveyance of air to be heated from the chamber 104 into the radiative section 78. As described above with respect to the first embodiment, appropriate fluid tight seals are provided to maintain separation of the flue gases and air to be heated.

The furnace 70 includes three additional intermediate walls 110, 112 and 114 which cooperate with the walls 100 and 106 to divide the length of the convective section 80 into four equal sections and corresponding horizontal passageways 116, 118, 120 and 122. The walls 110, 112 and 114 are alternately spaced from the back or front wall of the furnace to provide a serpentine flow path by connecting the horizontal passageways 116, 118, 120 and 122 in series in the same manner as described above with respect to the furnace 10.

Air to be heated is drawn into the blower chamber 104 and passed through air tubes 108 and the convective section 80 for heat transfer with the flue gases flowing over the tubes and along the serpentine path provided by the passageways 116, 118, 120 and 122. The warmed air passes from the tubes 108 into the radiative section 78 for further heat transfer with the exterior surface of the firetube 94 and fins 96. The warmed air is then passed through the top wall 82 of the furnace and conveyed to the space to be heated.

A variety of different configurations are possible for the radiative section of the heat exchanger. In addition to tubes, either finned or non-finned, various types of radiative manifolds are possible for lowering the temperature of the flue gases before passing the flue gases to the shell side of a series of cross flow tube-and-shell type heat exchange layers. The radiative section can be either before or after the tube-and-shell section with respect to the flow of flue gases, and the heat transfer may be achieved by either co-current or countercurrent flow of the air with respect to the flue gases.

The descriptions herein are for purposes of example only. The number of vertical tubes; the arrangement of the tubes, e.g., in-line tube rows or staggered tube rows; the number of cross-flow passages; tube dimensions; and the configuration of the radiative firetube section, among other things, can be varied without departing from the principles of the invention, and are therefore within the spirit and scope of the disclosed invention.

As a particular example, a heat exchanger for a furnace having a rated input of 150,000 BTU/hr and which is capable of recovering about 80% of the heat generated during combustion has 60 vertical air tubes, each having a diameter of 1.75 inches and a length of 12 inches. The air tubes are arranged in alternating staggered rows of 8 and 7 tubes. Six horizontal firetubes having inshot burners with turbulators are provided. The firetubes are 17 inches in length and have a diameter of 2.25 inches. Each of three horizontal cross flow passages has a height of about 4 inches, a width of about 18 inches, and a depth of about 17 inches. The firetubes and air tubes are made from aluminized steel. The walls and partitions of the heat exchanger are constructed from sheet metal and the refractory lining 64 on the back wall is selected from conventional refractory materials commonly used in the manufacture of furnaces. The overall dimensions of the heat exchanger are about 15 inches in height, 18 inches in width and 19 inches in depth, thus achieving a more compact size than would otherwise be possible with conventional furnace designs.

While applicants do not intend to limit their invention based on the theory of operation, it is believed that the improved heat transfer characteristics, which are achieved in a compact arrangement made in accordance with the invention, are believed attributable to an improved inside heat transfer coefficient, and the air flow rate, which is higher than the flue gas flue rate, being better able to accommodate a lower heat transfer coefficient. Thus, in addition to a higher overall heat transfer coefficient, the low flow flue gases get the benefit of the higher outside heat transfer coefficient, which in turn allows the invention to achieve a desired thermal efficiency in a smaller heat exchanger than would be required with conventional arrangements.

While what is presently considered to be the most practical and preferred embodiments of the invention have been described, it is to be understood that the invention is not to be limited to the disclosed embodiments but, to the contrary, is intended to cover various modifications and equivalent arrangements included within the spirit and scope of the appended claims as interpreted with reference to the disclosure herein.

What is claimed is:

1. A heating system comprising a compact heat exchanger including a first heat transfer conduit means disposed within a first surrounding enclosure that substantially surrounds the first conduit means, and a second heat transfer conduit means disposed within a second surrounding enclosure that substantially surrounds the second conduit means, said first conduit means being in fluid communication with said second enclosure and said first enclosure being in fluid communication with said second conduit means, burner means for burning air and fuel to form products of combustion and for conveying the products of combustion through the heat exchanger, and blower means for flowing air to be heated through said heat exchanger and to a space to be heated, said burner means being operatively connected to said heat exchanger to convey said products of combustion through said first conduit means and said second enclosure, and said blower means being operatively connected to said heat exchanger to flow air to be heated through said first enclosure and said second conduit means, said second conduit means including a plurality of tubular members having longitudinal axes extending through said second enclosure, said second enclosure including wall means providing a serpentine flow path for said products of combustion extending transversely back and forth across the longitudinal axes of said tubular members and through said second enclosure, said second enclosure and said wall means confining the path of the products of combustion as they enter the second enclosure to a cross-section that is sufficiently less in dimension, measured in the direction of the longitudinal axes of said tubular members, than the effective lengths of the tubular members to permit the wall means to divide the second enclosure into at least three transverse paths across the tubular members and of generally equal cross-sectional area.

2. A heating system as in claim 1, wherein said second conduit means and surrounding enclosure each have a cross sectional flow area, and the cross sectional flow area of said second conduit means is less than the cross sectional flow area of said second surrounding enclosure.

3. A heating system as in claim 1, wherein said heating system is arranged so that said burner means flows said products of combustion sequentially through said first conduit means and then said second enclosure and said blower means flows said air to be heated sequentially through said first enclosure and then said second conduit means to provide concurrent heat transfer between said products of combustion and air to be heated.

4. A heating system as in claim 3, wherein said first conduit means and first enclosure are disposed below said second conduit means and second enclosure.

5. A heating system as in claim 4, wherein said first conduit means comprise a plurality of firetubes and said burner means comprise a plurality of burners, each of said burners being associated with one of said firetubes.

6. A heating system as in claim 5, wherein said heating system includes a shell-and-tube heat exchanger having a plurality of tubes extending longitudinally through a shell region which respectively provide said second conduit means and said second enclosure.

7. A heating system as in claim 6, wherein each of said burners is an inshot burner and each of said firetubes includes a turbulator mounted therein to enhance heat transfer to the air to be heated and to thereby reduce the temperature of the products of combustion to enable the firetubes and second conduit means to be formed of aluminized steel.

8. A heating system as in claim 1, wherein said heating system is arranged so that said burner means flows said products of combustion sequentially through said first conduit means and then said second enclosure and said blower means flows said air to be heated sequentially through said second conduit means and then said first enclosure to provide countercurrent heat transfer between said products of combustion and air to be heated.

9. A heating system as in claim 1, wherein said first conduit means and first enclosure are disposed above said second conduit means and second enclosure.

10. A heating system as in claim 9, wherein said first conduit means comprises a firetube having radially extending fins and said burner means comprises an inshot burner associated with said firetube.

11. A heating system as in claim 10, wherein said heating system includes a shell-and-tube heat exchanger having a plurality of tubes extending longitudinally through a shell region which respectively provide said second conduit means and said second enclosure.

12. A heating system comprising a compact heat exchanger including a firetube enclosure and an air tube enclosure, burner means for burning air and fuel to form products of combustion and for conveying the products of combustion through the heat exchanger, and blower means for flowing air to be heated through the heat exchanger and to a space to be heated, said burner means including at least one elongated firetube disposed in said firetube enclosure for containing products of combustion and transferring heat energy from the combustion products to air to be heated flowing over substantially all of said firetube, said air tube enclosure including a plurality of air tubes arranged to receive therein heated air from said firetube enclosure for further heat transfer with said combustion products from said at least one firetube flowing over said air tubes, each of said air tubes having a generally tubular configuration and a longitudinal axis extending through said air tube enclosure, said air tube enclosure including wall means providing a serpentine flow path for said combustion products transversely back and forth across the longitudinal axes of said air tubes and through said air tube enclosure in a plurality of transverse passes, said air tube enclosure end wall means confining the path of combustion products as they enter the air tube enclosure to a cross-section that is sufficiently less in dimension, measured in the direction of the longitudinal axes of the air tubes, than the effective lengths of the air tubes to permit the wall means to divide the air tube enclosure into at least three transverse paths across the air tubes and of generally equal cross-sectional area.

13. A heating system as in claim 12, wherein said firetube enclosure is mounted above said air tube enclosure of said heat exchanger and air to be heated passes upwardly through the air tubes and then over said firetube and combustion products flow downwardly along said serpentine flow path for countercurrent heat transfer with the air to be heated.

14. A heating system as in claim 13, wherein said at least one firetube has a U-shape and radially extending fins.

15. A heating system as in claim 12, wherein said firetube enclosure is mounted below said air tube enclosure of said heat exchanger and air to be heated passes upwardly over the firetubes and through the air tubes and combustion products flow upwardly along said serpentine flow path for concurrent heat transfer with the air to be heated.

16. A heating system as in claim 15, wherein a plurality of said firetubes are provided, and said burner means includes a plurality of burners, each of said burners being associated with a firetube.

17. A heating system as in claim 16, wherein a turbulator is mounted in each of said firetubes to enhance heat transfer to the air to be heated and to thereby reduce the temperature of the combustion products to enable the firetubes and air tubes to be formed of aluminized steel.

18. A heating system as in claim 12, wherein said air tubes include inside surfaces for confining said air to be heated and outside surfaces for contacting the combustion products, said air tube enclosure cooperates with said outside surfaces of said air tubes to provide an outside combustion products flow path, said inside surfaces of said air tubes cooperate to provide an inside air flow path for said air to be heated, said inside air flow path having a total cross-sectional area which is less than that of said outside combustion products flow path, and said air flow is greater than said combustion products flow whereby said inside and outside heat transfer coefficients are more closely matched and said heat exchanger has a higher overall heat transfer coefficient than if the flow paths were interchanged.

19. A heating system comprising a compact heat exchanger including a firetube enclosure and an air tube enclosure, burner means for burning air and fuel to form products of combustion and for conveying the products of combustion through the heat exchanger, and blower means for flowing air to be heated through the heat exchanger and to a space to be heated, said burner means including at least one elongated firetube disposed in said firetube enclosure for containing products of combustion and transferring heat energy from the combustion products to air to be heated flowing over substantially all of said firetube, said air tube enclosure including a plurality of air tubes arranged to receive therein heated air from said firetube enclosure for further heat transfer with said combustion products from said at least one firetube flowing over said air tubes, the air tubes having inlet openings adjacent said firetube, the firetube having a longitudinal side facing, free of obstruction, a plurality of said air tube inlet openings such that radiation from said firetube can directly enter said openings and provide further heat transfer between said combustion products and air by radiation from said firetube to said air tubes.

20. A heating system as set forth in claim 19, wherein a plurality of firetubes are provided in said firetube enclosure and said firetubes are each arranged to radiate heat to inlet openings of said air tubes.

* * * * *

UNITED STATES PATENT AND TRADEMARK OFFICE

CERTIFICATE OF CORRECTION

PATENT NO. : 5,205,276

DATED : April 27, 1993

INVENTOR(S) : Michael A. Aronov and Roger D. Sheridan

It is certified that error appears in the above-identified patent and that said Letters Patent is hereby corrected as shown below:

Column 8, line 29 (Claim 9, line 1), delete "claim 1" and insert --claim 8--.

Signed and Sealed this

Twenty-sixth Day of April, 1994

*Attest:*

*Attesting Officer*

Bruce Lehman

BRUCE LEHMAN

*Commissioner of Patents and Trademarks*